US008047677B2

(12) United States Patent
Wang

(10) Patent No.: US 8,047,677 B2
(45) Date of Patent: Nov. 1, 2011

(54) LED ILLUMINATOR

(75) Inventor: Meng-Hua Wang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 427 days.

(21) Appl. No.: 11/967,105

(22) Filed: Dec. 29, 2007

(65) Prior Publication Data

US 2009/0052191 A1 Feb. 26, 2009

(30) Foreign Application Priority Data

Aug. 24, 2007 (CN) ..... 2007 1 0201470

(51) Int. Cl.
*F21S 4/00* (2006.01)
*F21V 21/00* (2006.01)

(52) U.S. Cl. ..... 362/249.02; 362/247; 362/300; 362/307; 362/346; 362/800

(58) Field of Classification Search ..... 362/235, 362/247, 249.02, 296.01, 296.09, 267, 300–302, 362/307–308, 341, 346, 545, 800
See application file for complete search history.

(56) References Cited

U.S. PATENT DOCUMENTS 5,890,794 A 4/1999 Abtahi et al.
6,019,493 A * 2/2000 Kuo et al. ..... 362/335
6,547,416 B2 * 4/2003 Pashley et al. ..... 362/231
2006/0050514 A1 3/2006 Opolka
2006/0061990 A1 * 3/2006 Chinniah et al. ..... 362/247
2006/0186425 A1 8/2006 Yano et al.

FOREIGN PATENT DOCUMENTS

CN 02246403.4 9/2003
CN 2570601 A 9/2003
CN 01805345.9 6/2005
CN 1828131 A 9/2006
CN 200520116751.6 12/2006
TW M250106 11/2004
TW 200607956 3/2006
TW M294621 7/2006
TW M318698 9/2007

* cited by examiner

*Primary Examiner* — Jason Moon Han

(74) *Attorney, Agent, or Firm* — Altis Law Group, Inc.

(57) ABSTRACT

A light emitting diode illuminator includes a reflecting shell (120), a light emitting diode light source (140) and a transparent cover (160). The reflecting shell includes a plurality of sequentially connected hollow tapered bodies (122, 124) having different taper angles. The tapered bodies cooperatively form a receiving space (123). The light source is installed at an end of the receiving space. The transparent cover is disposed at an opposite end of the reflecting shell away from to the light source and configured for directing light emitted from the light source out from the light emitting diode illuminator.

6 Claims, 13 Drawing Sheets

LED ILLUMINATOR

BACKGROUND

1. Field of the Invention

The present invention relates generally to an illuminator, and more particularly to an illuminator incorporating a light emitting diode (LED) as a light source.

2. Description of Related Art

In recent years, light emitting diodes (LEDs) have become highly efficient light sources and are used widely in such fields as automotive, displays, and traffic control.

Light generated by LEDs have the advantage in that it can be directed or aimed by using some kind of reflectors. However, because a light field of the LED is usually concentrated illuminating devices using LEDs cannot meet the needs of illuminating a relatively large area. Further, in some cases, such as the street lamp, a long and narrow light field is desired but not easily obtained with present methods. Therefore, there is a need in the art for an LED illuminator, which overcomes the above-mentioned problems.

SUMMARY

In accordance with an embodiment, a light emitting diode (LED) illuminator includes a reflecting shell, at least one LED, and a transparent cover. The reflecting shell includes a plurality of sequentially connected hollow tapered bodies having different taper angles. The hollow tapered bodies cooperatively form a receiving space. The LED is installed at an end of the receiving space. The transparent cover is disposed at an opposite end of the reflecting shell away from the LED and configured for directing light emitted from the LED out from the LED illuminator.

Other advantages and novel features of the present invention will be drawn from the following detailed description of a preferred embodiment of the present invention with attached drawings, in which:

BRIEF DESCRIPTION OF THE DRAWINGS

The present invention is described in greater detail hereinafter, by way of example only, through description of a preferred embodiment thereof and with reference to the accompanying drawing in which.

DETAILED DESCRIPTION OF THE EMBODIMENTS

Figure 1:
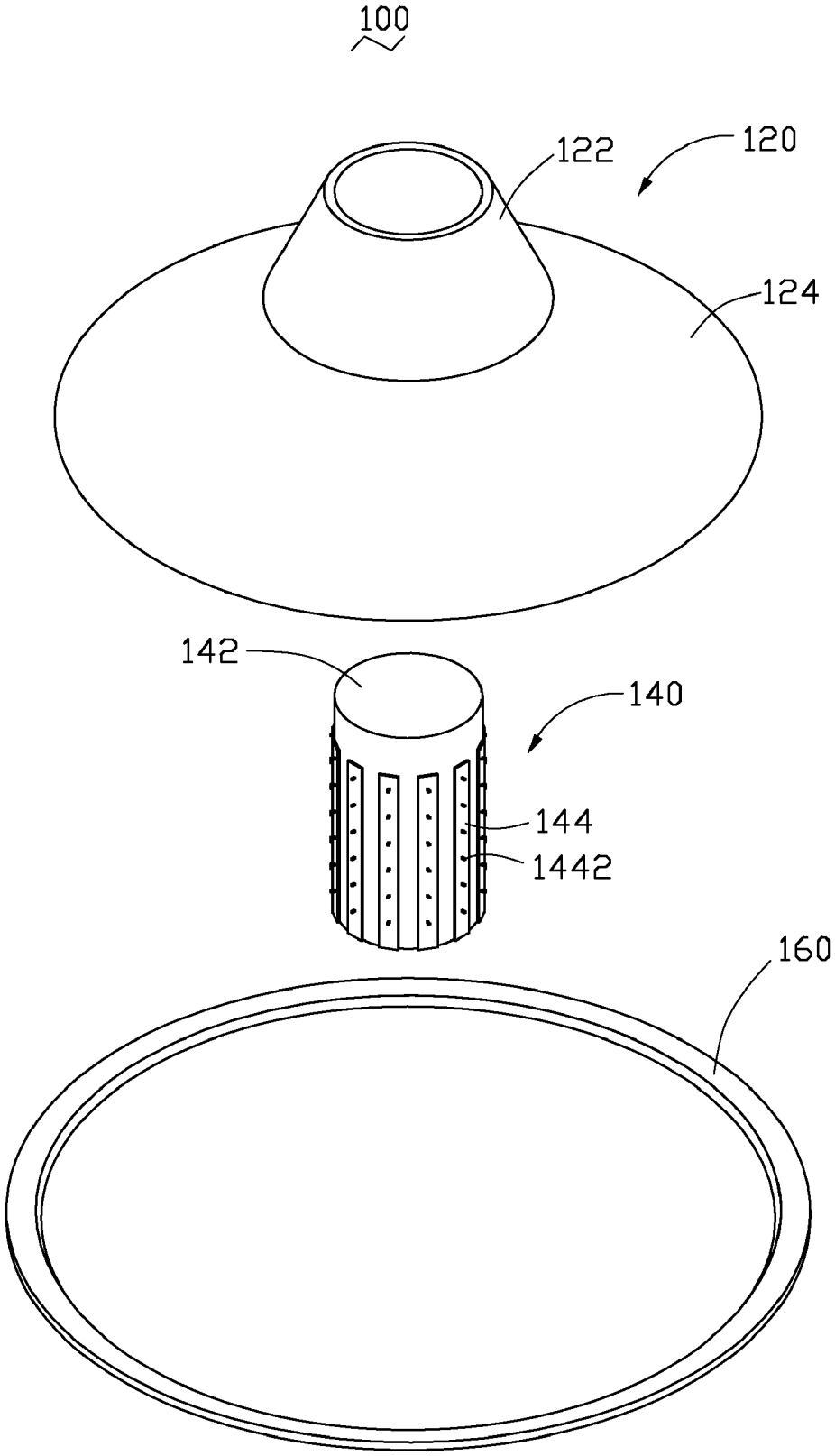
FIG. 1 is an exploded, isometric view of an LED illuminator in accordance with a first embodiment of the present invention.
Figure 2:
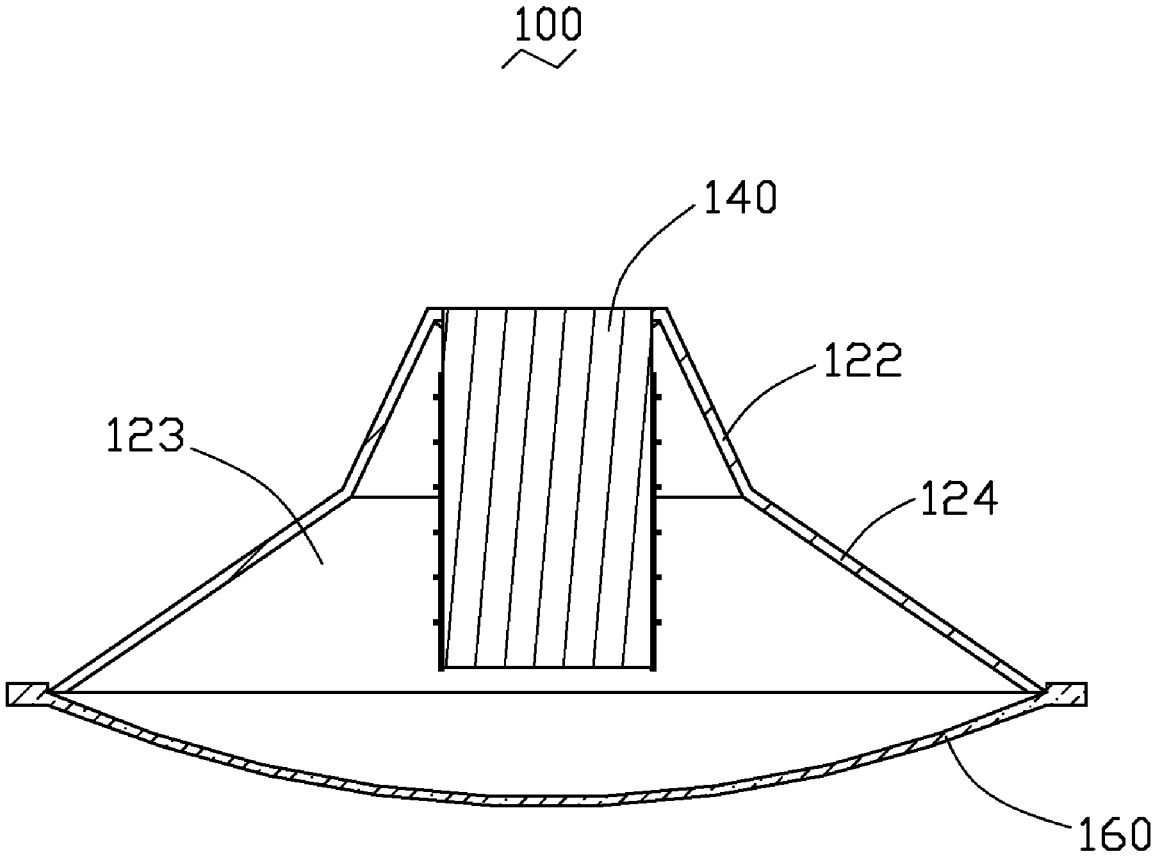
FIG. 2 is an assembled, cross-sectional view of the LED illuminator of FIG. 1.
Figure 3:
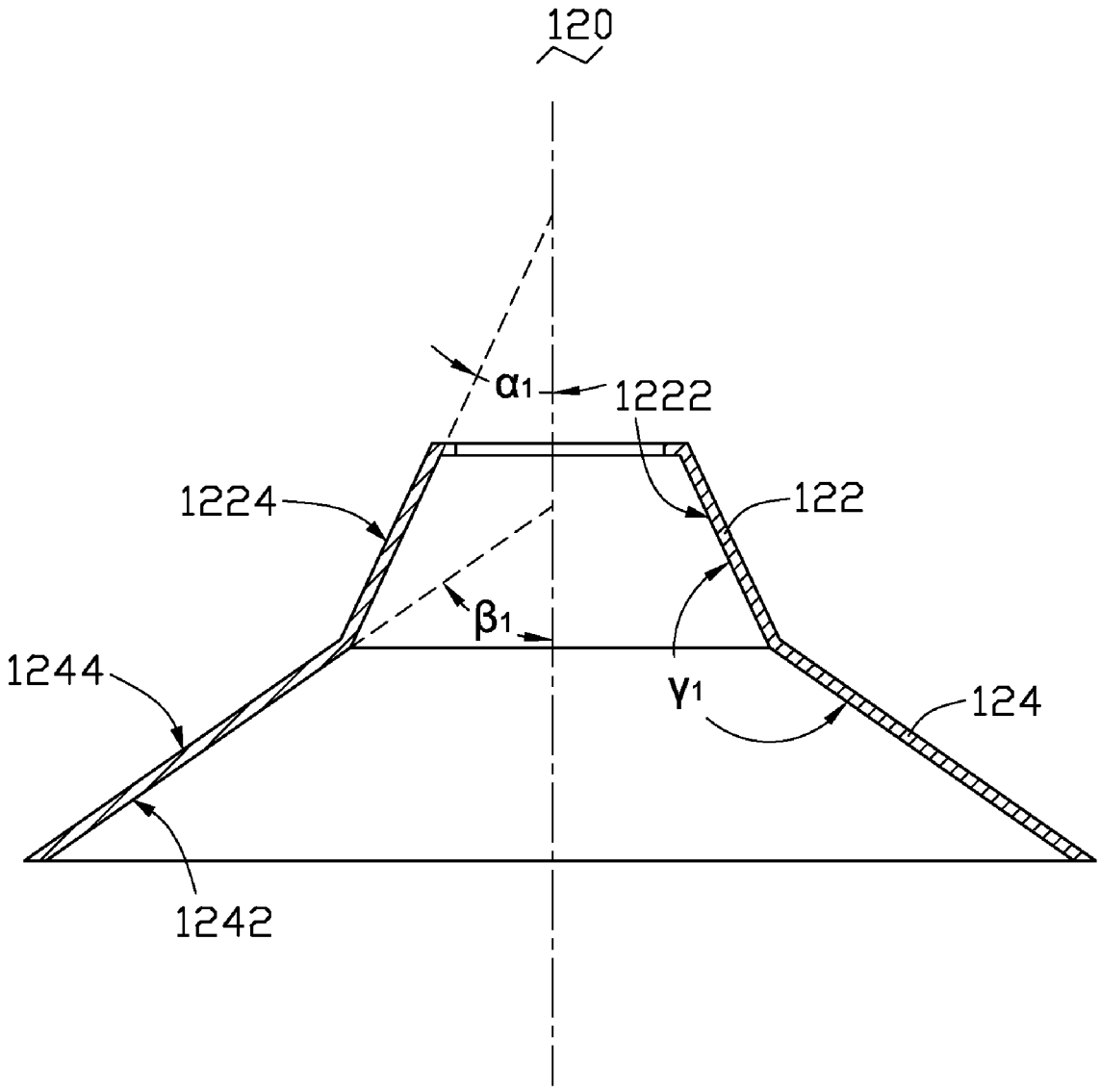
FIG. 3 is an enlarged view of a reflecting shell of the LED illuminator of FIG. 2.

A detailed explanation of a light emitting diode (LED) illuminator 100 according to a first embodiment of the present invention will now be made with reference to the drawings attached hereto. Referring to FIGS. 1-3, the LED illuminator 100 includes a light source 140, a reflecting shell 120, and a transparent cover 160.

The reflecting shell 120 includes an upper body 122 and a lower body 124 extending from the upper body 122. The upper and lower bodies 122, 124 are hollow, and thus the two bodies 122, 124 cooperatively define a receiving space 123 therein. Particularly referring to FIG. 3, the upper and lower bodies 122, 124 are similar to each other, and each body 122, 124 has a truncated cone shape. Inner surfaces 1222, 1242 and outer surfaces 1224, 1244 of each body 122, 124 are respectively parallel. The upper body 122 is smaller than the lower body 124 with the large end of its truncated cone shape matching in size with and connected to the small end of the truncated cone shape of the lower body 124. The difference between the two bodies 122, 124 of the reflecting shell 120 is that a taper angle $\alpha 1$ of the upper body 122 is smaller than a taper angle $\beta 1$ of the lower body 124. The taper angle $\alpha 1$, $\beta 1$ of each body 122, 124 is the angle defined between the axis and the generatrix thereof. As the taper angle $\alpha 1$ of the upper body 122 is smaller than that of the lower body 124, an inner angle $\gamma 1$ formed by the inner surfaces 1222, 1242 is greater than 180 degrees.

The light source 140 is installed in the receiving space 123. The light source 140 includes a column-shaped base 142 and a plurality of LED arrays 144 arranged around the base 142. Each array 144 includes a number of LEDs 1442 being linearly arranged, and thus achieving a long strip-like shape. In this embodiment, each array 144 has six LEDs 1442. The arrays 144 are arranged along a circumferential direction thereof being evenly spaced from each other. A diameter of the base 142 of the light source 140 is approximately the same as the inner diameter of the upper body 122. In assembly of the LED illuminator 100, a top end of the base 142 of the light source 140 is assembled in the top end of the upper body 122 thus sealing the top end of the reflecting shell 120. A power source can be connected to the base 142 to apply current to the LEDs 1442.

The transparent cover 160 is connected to a bottom end of the lower body 124 of the reflecting shell 120. Thus the bottom of the reflecting shell 120 is sealed by the cover 160 to avoid dust or vapor getting into the reflecting shell 120. The cover 160 can be selected from a group consisting of spherical lens, aspherical lens, micro-lens array, micro-prism array, lenticular array, or Fresnel lens, which can adjust the light field of the LEDs 1442. The cover 160 is usually made of glass or optically transmissive plastic. In this embodiment, the cover 160 is curved with convex side facing away from the LEDs 1442. Conversely, the cover 160 can be a flat board only for transmission of the light.

Figure 4:
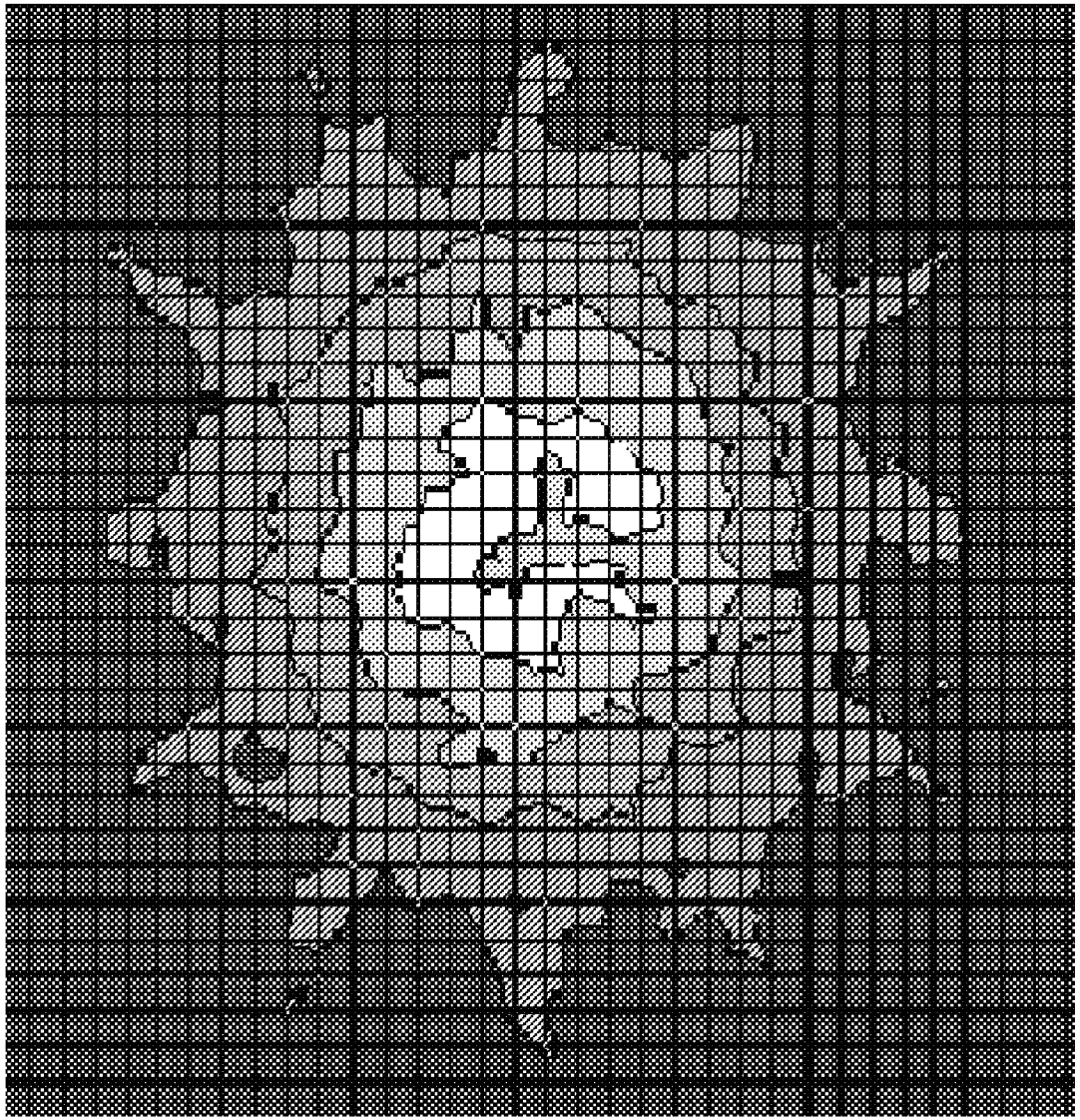
FIG. 4 is a simulated view of a light field of the LED illuminator of FIG. 1.

During operation of the LED illuminator 100, current is applied to the LEDs 1442, the LEDs 1442 radiate light, which is directed by the reflecting shell 120 out through the transparent cover 160 of the LED illuminator 100. As shown in FIG. 4, the light field of the LED illuminator 100 is approximately circular-shaped. Thus the shape of the light field of the LEDs 1442 is changed and enlarged compared to conventional LED illuminators. Thus the LED illuminator 100 incorporating the sequentially connected hollow tapered bodies 122, 124 can change the light field of the LEDs 1442 to a more desirable and useful shape and size.

Figure 5:
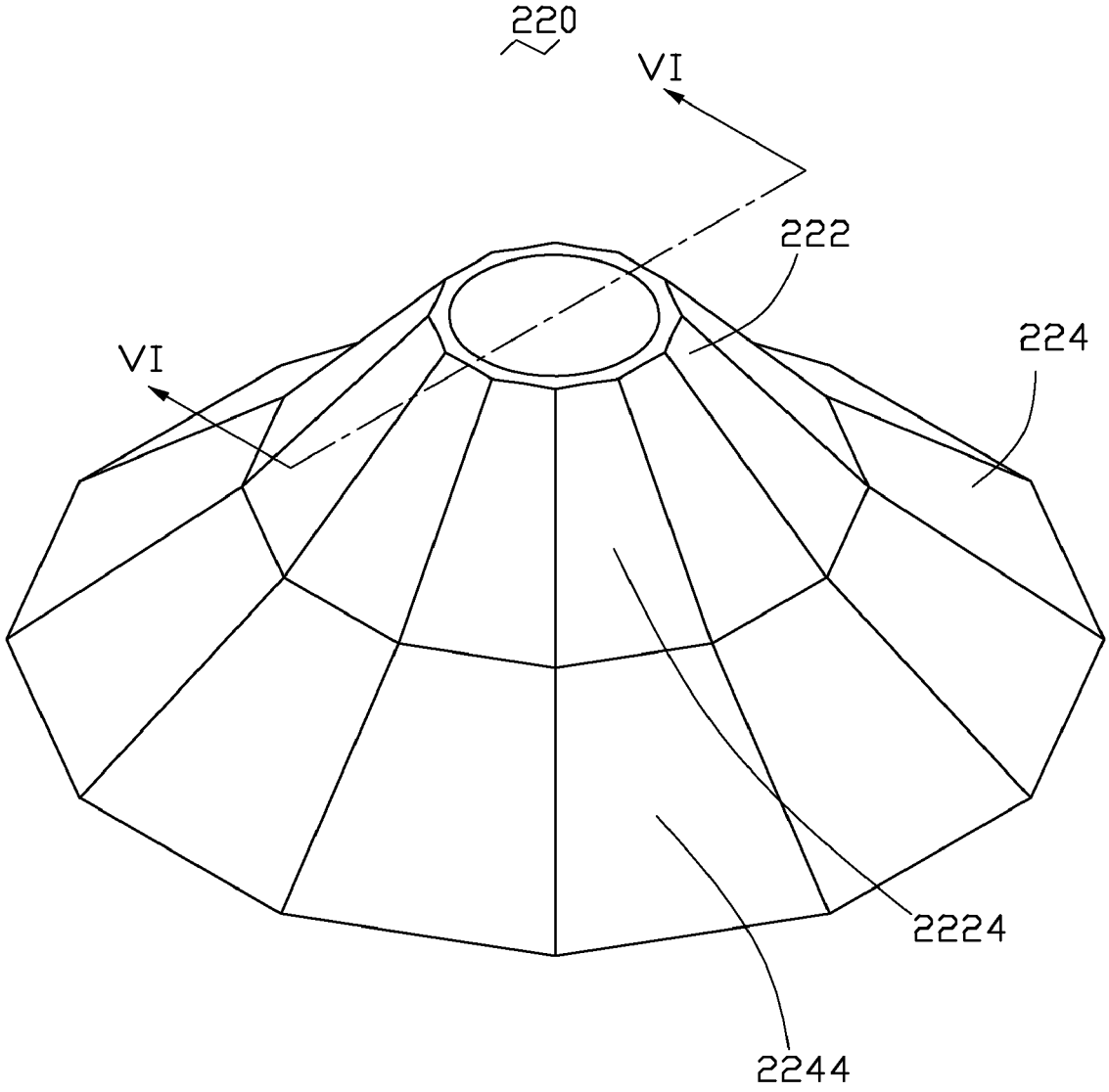
FIG. 5 is an isometric view of a reflecting shell according to a second embodiment of the present invention.
Figure 6:
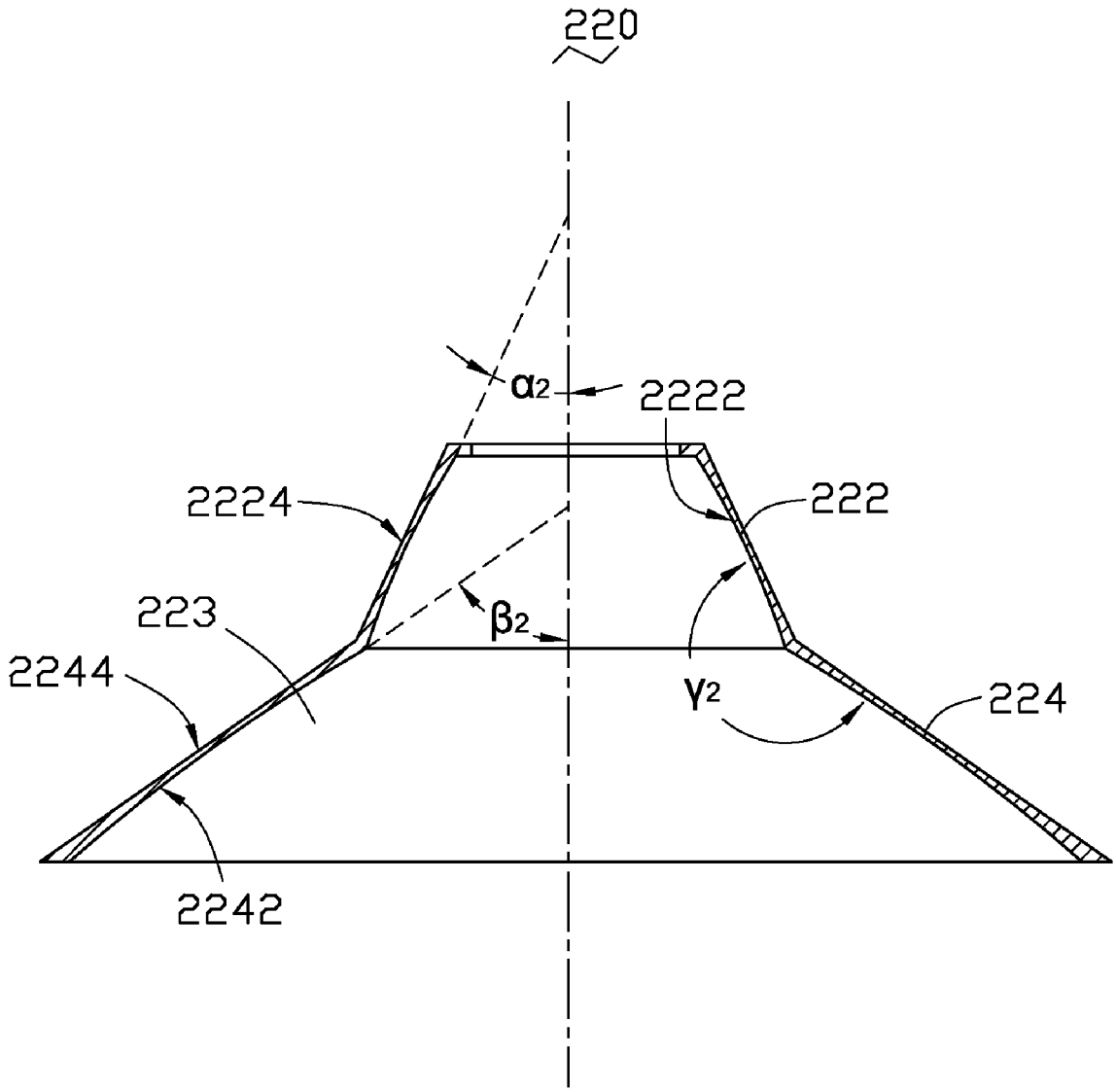
FIG. 6 is a cross-sectional view of the reflecting shell of FIG. 5 taken along line VI-VI.
Figure 7:
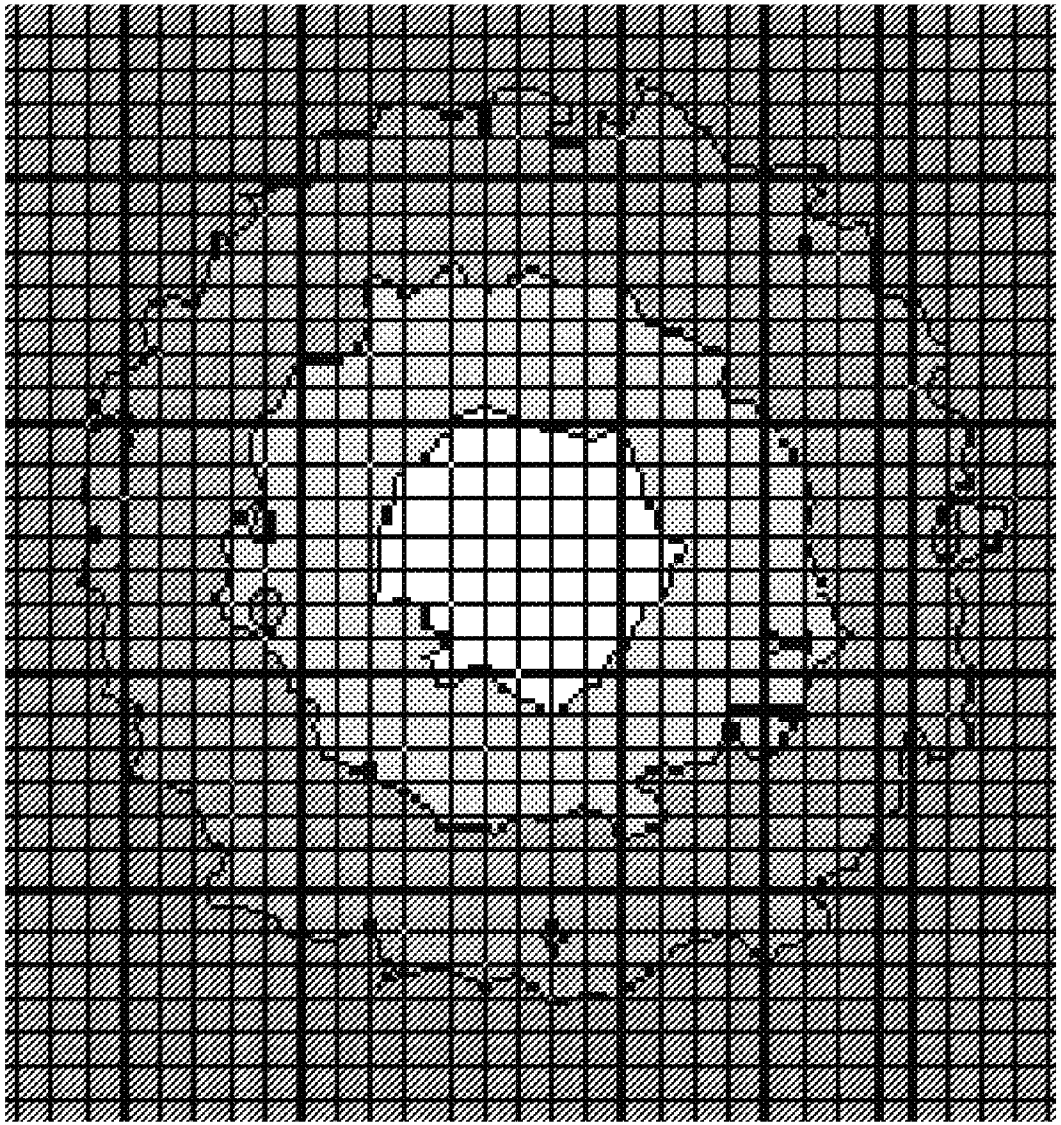
FIG. 7 shows a simulated view of the light field of the LED illuminator incorporating the reflecting shell of FIG. 5.

FIGS. 5-6 show a reflecting shell 220 according to a second embodiment of the present invention. Similar to the first embodiment, the reflecting shell 220 includes a tapered upper body 222 and a tapered lower body 224 sequentially connected together. The inner surfaces 2222, 2242 of the two bodies 222, 224 are approximately conoid. On the assumption that the inner surfaces 2222, 2242 of the two bodies 222, 224 are conoid, the taper angle $\alpha 2$, $\beta 2$ of the inner surface 2222, 2242 of each body 222, 224 is in range of 10~70 degrees. The taper angle $\alpha 2$ of the inner surface 2222 of the upper body 222 is smaller than the taper angle $\beta 2$ of the inner surface 2242 of the lower body 224. The inner angle $\gamma 2$ formed by the inner surfaces 2222, 2224 is larger than 180 degrees. One difference between this embodiment and the first embodiment is that the inner surface 2222, 2242 of each body 222, 224 is concave, and thus the generatrix of the inner surface 2222, 2242 of each body 222, 224 is a curved line. It is to be understood that the inner surface 2222, 2242 of each body 222, 224 can alternatively be convex. In addition, the outer surfaces 2224, 2244 of the upper and lower bodies 222, 224 are in the form of truncated pyramids. In this embodiment, the outer surfaces 2224, 2244 of the two bodies 222, 224 are in the form of twelve-sided truncated pyramids. In other words, the outer surface 2242, 2244 of each body 222, 224 includes twelve sidewalls being connected end to end. Each sidewall is planar and trapezoidal. It is to be understood that the number of sides of each of the truncated pyramids is not limited to twelve. For example, five-sided truncated pyramids, or twenty-sided truncated pyramids, are also suitable. FIG. 7 shows the simulated view of the light field of the LED illuminator incorporating the reflecting shell 220. As seen, the light field is generally circular.

Figure 8:
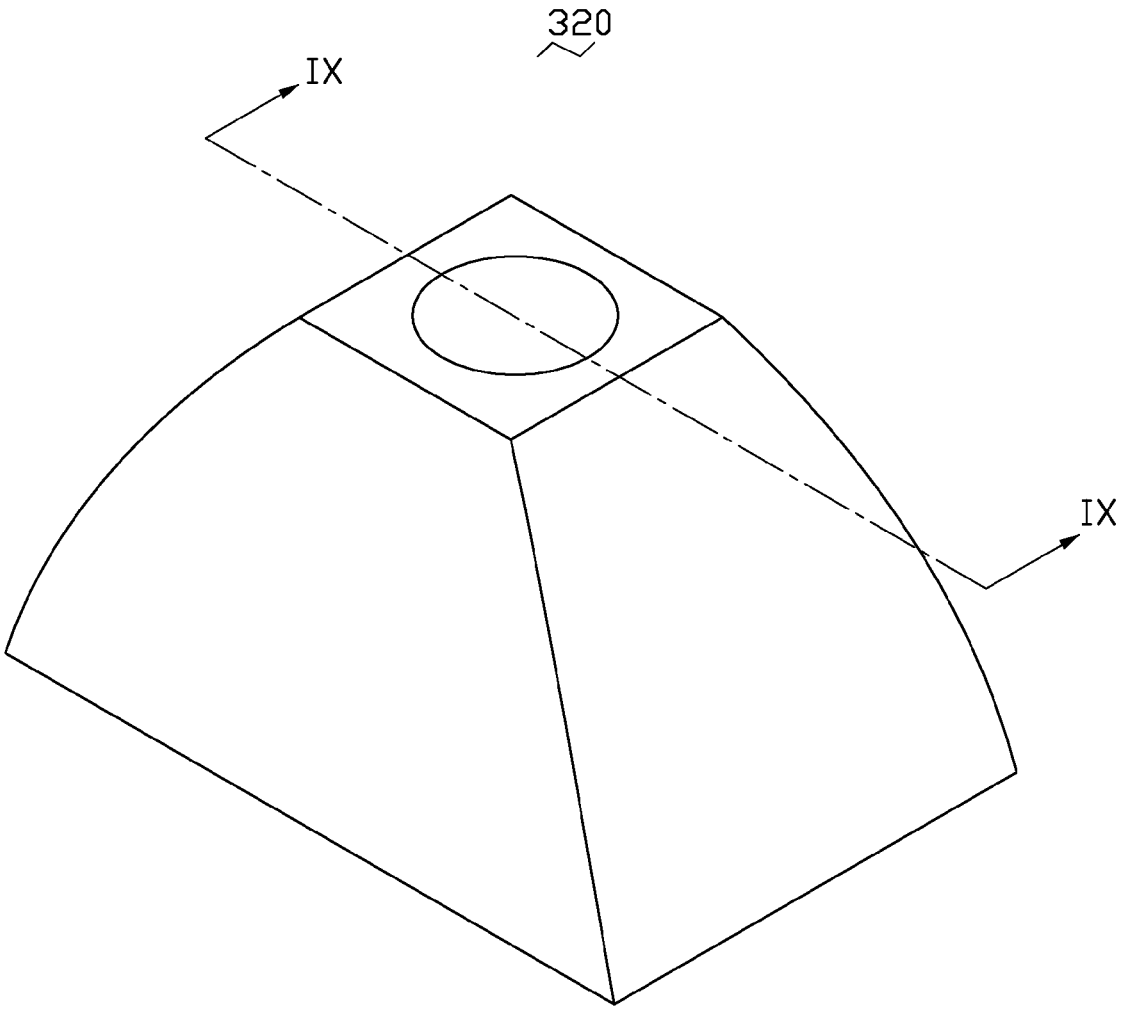
FIG. 8 shows an isometric view of a reflecting shell according to a third embodiment of the present invention.
Figure 9:
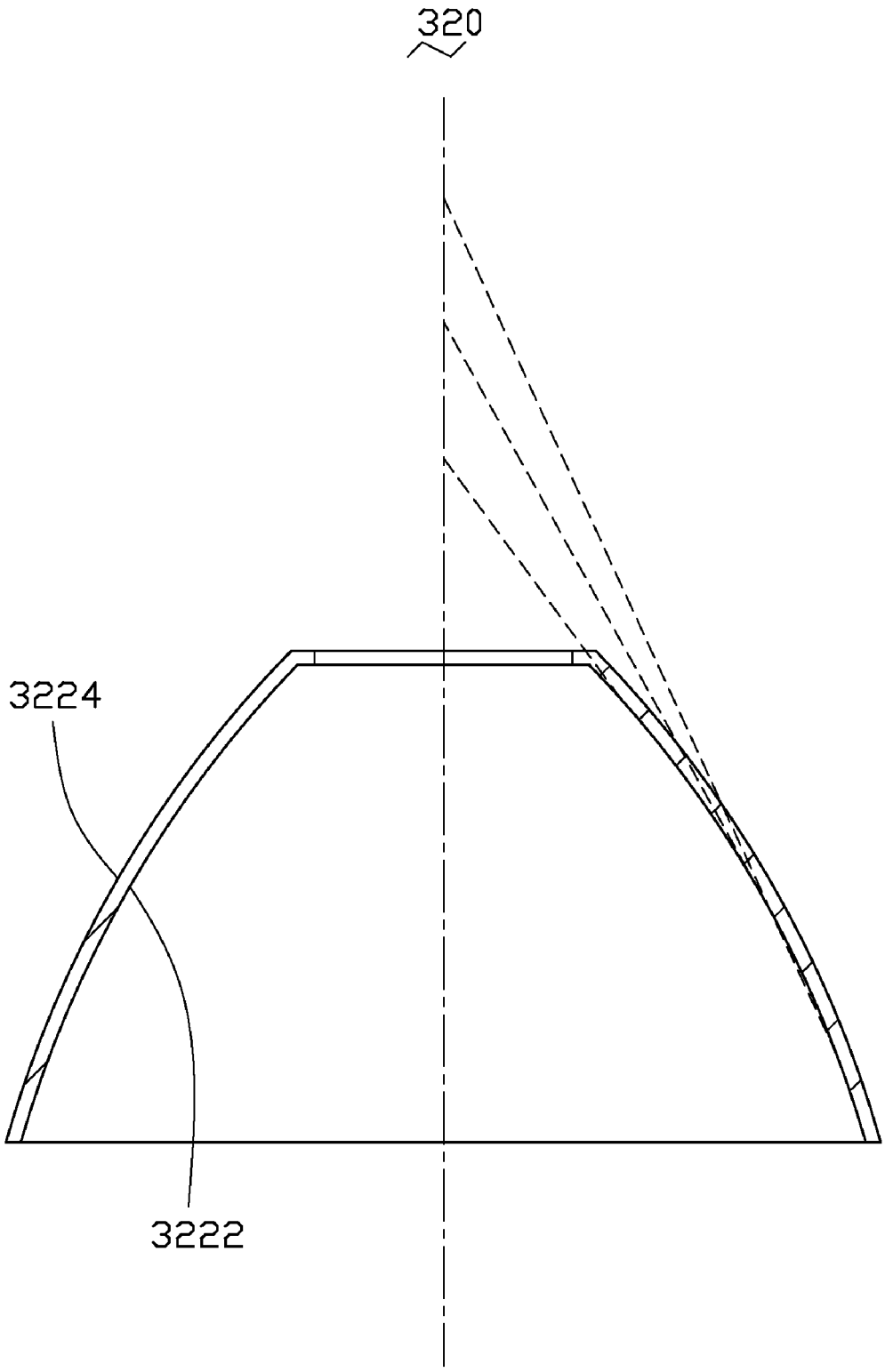
FIG. 9 is a cross-sectional view of the reflecting shell of FIG. 8 taken along line IX-IX.
Figure 10:
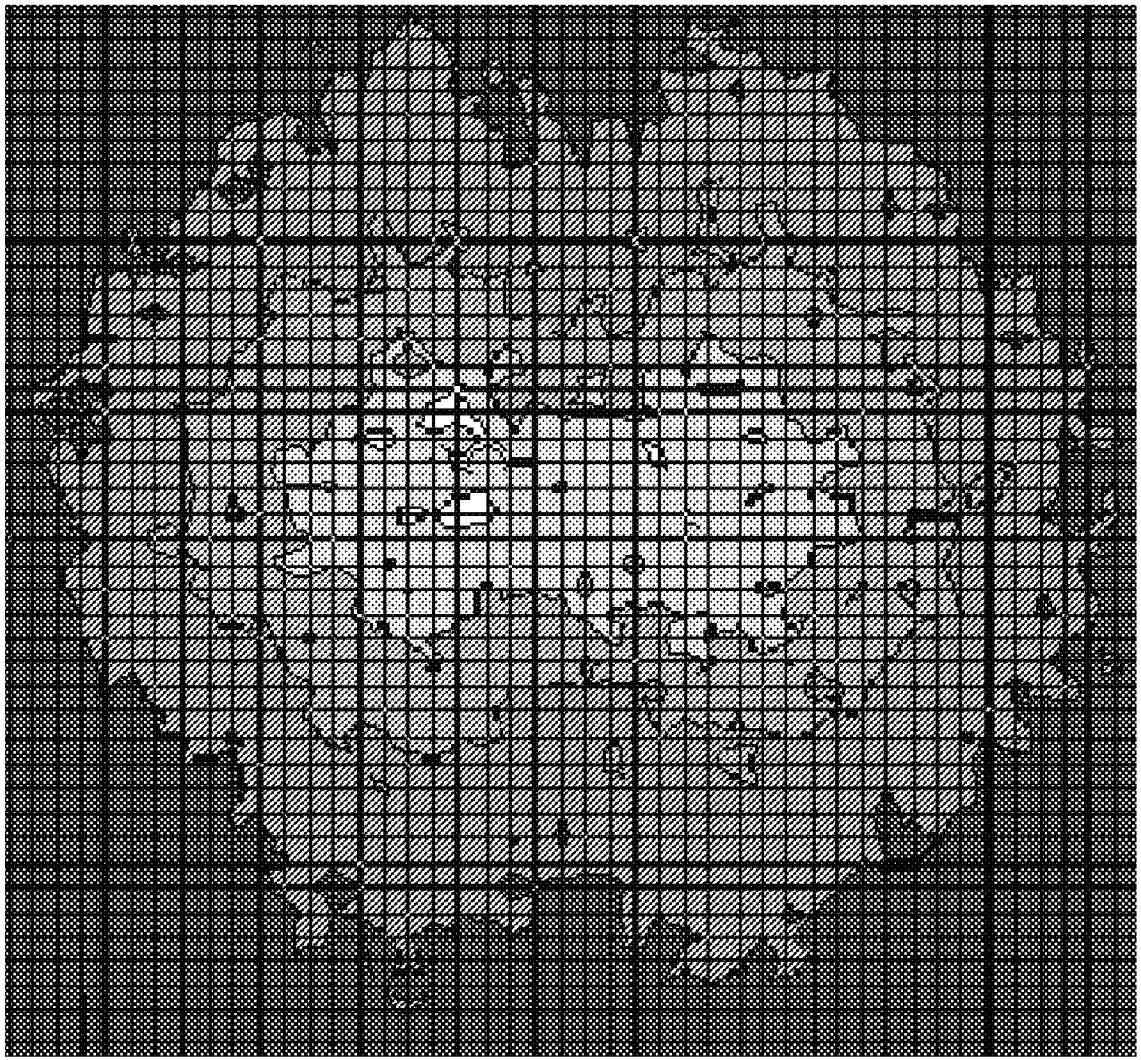
FIG. 10 shows a simulated view of the light field of the LED illuminator incorporating the reflecting shell of FIG. 9.

In FIGS. 8-9, a reflecting shell 320 according to a third embodiment of the present invention is shown. The reflecting shell 320 includes a plurality of hollow, tapered bodies sequentially connected together. Each of the bodies is generally in the form of four-sided truncated pyramid, except that each of the four sides is curved. In particular, each of the four sides has a convex outer surface and a concave inner surface. Cooperatively the inner surfaces of the bodies form a smooth concave inner surface 3222 of the reflecting shell 320, and cooperatively the outer surfaces of the bodies form a smooth convex outer surface 3224 of the reflecting shell 320. The taper angles of the bodies decrease with each successive body along a downward direction of the axis of the reflecting shell 320. As shown in FIG. 10, a simulated view of the light field of the LED illuminator is elongated and is approximately elliptic, which is similar to the shape of a street and thus can be used for illuminating the street.

Figure 11:
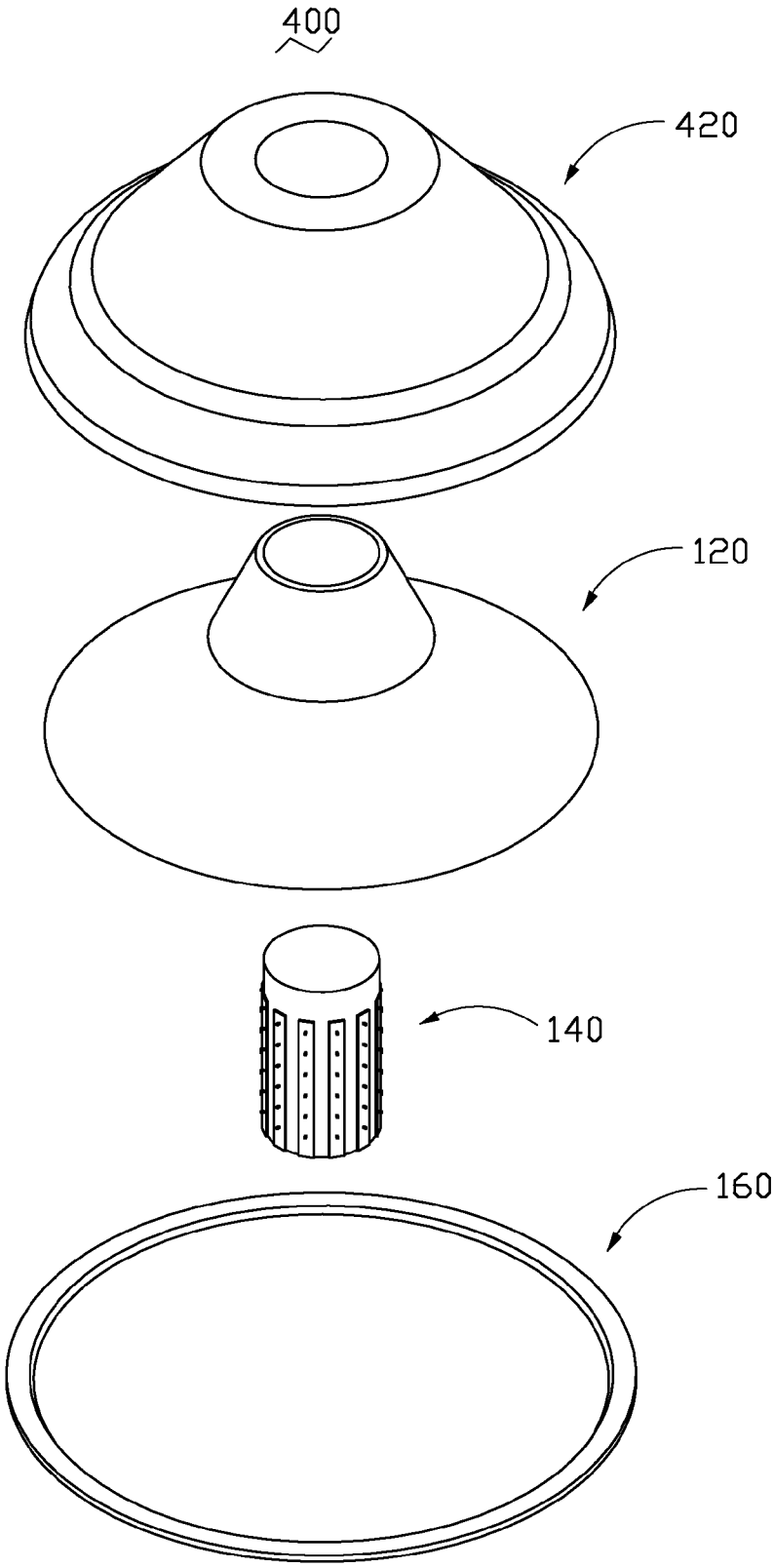
FIG. 11 shows an isometric, exploded view of a fourth embodiment of the LED illuminator.
Figure 12:
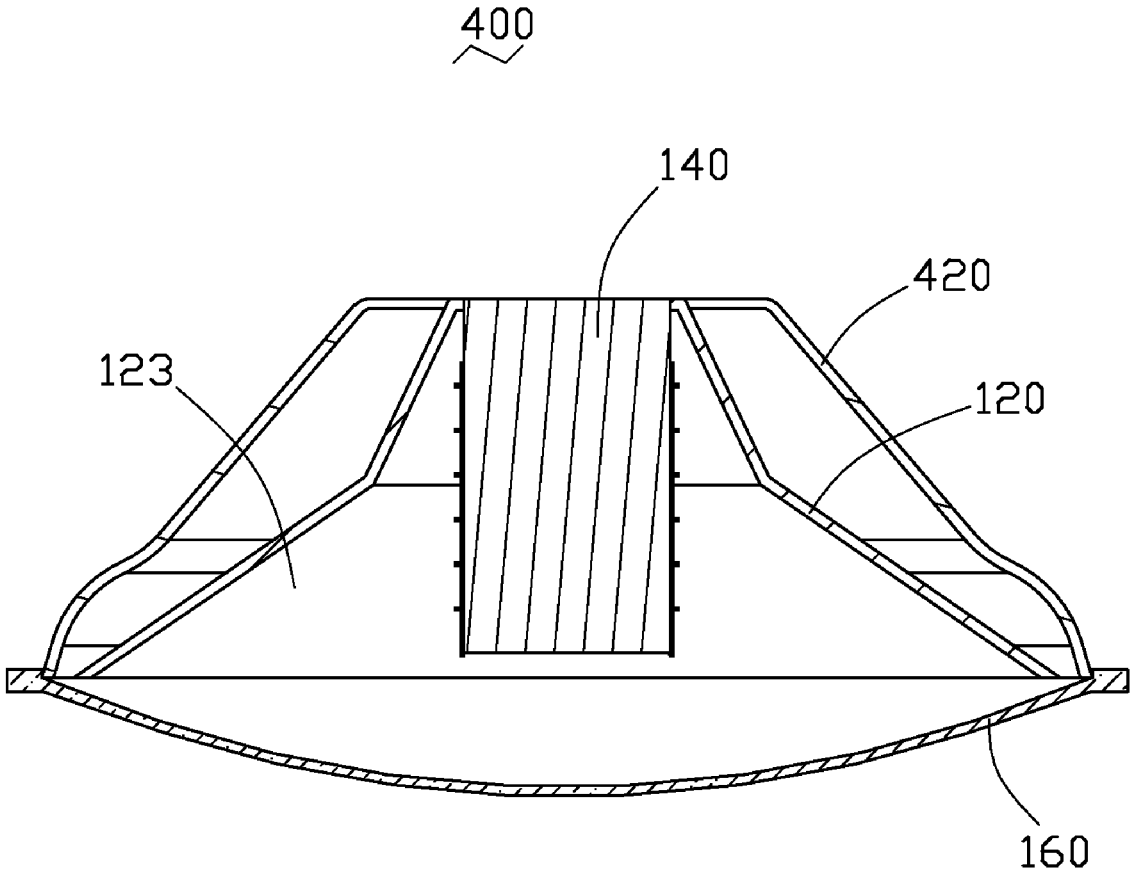
FIG. 12 is an assembled, cross-sectional view of the LED illuminator of FIG. 11.
Figure 13:
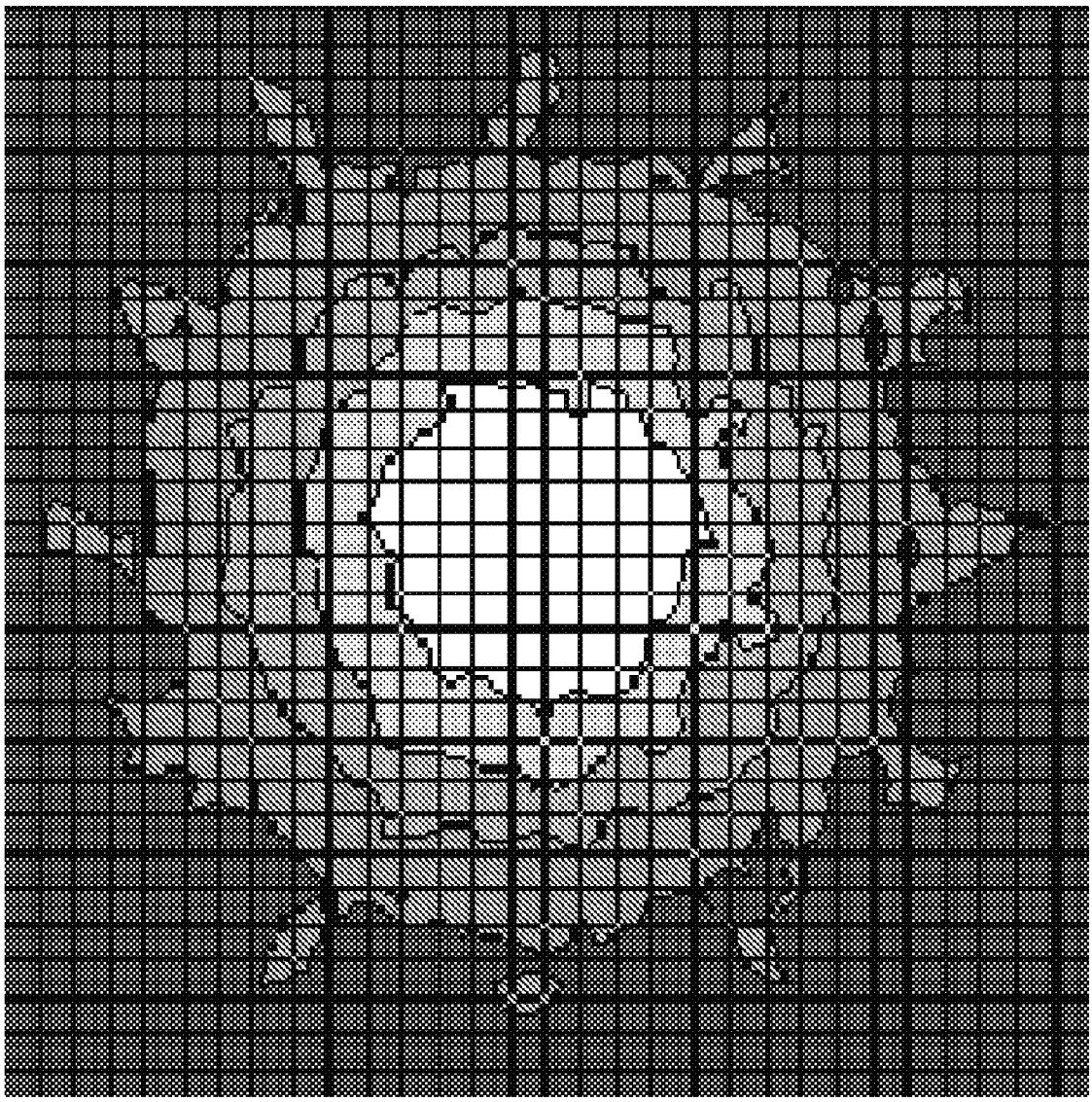
FIG. 13 shows a simulated view of the light field of the LED illuminator of FIG. 11.

Referring to FIGS. 11-12, a fourth embodiment of the LED illuminator 400 according to the present invention is shown. The LED illuminator 400 includes a light source 140, a transparent cover 160, a reflecting shell 120, and an outer shell 420. The Light source 140, the reflecting shell 120 and the transparent cover 160 are substantially the same as the first embodiment. The outer shell 420 is mounted around the reflecting shell 120 with an inner space defined therebetween. The reflecting shell 120 is made of opaque reflecting material or translucent reflecting material. The outer shell 420 includes an upper body and a lower body extending downwardly from the upper body. Each body of the outer shell 420 has a truncated cone shape. The top end of the upper body of the outer shell 420 extends inwardly and thus abuts the outer surface of the upper body of the reflecting shell 120. Thus the top ends of the shells 120, 420 are connected closely. The bottom ends of the lower bodies of the shells 120, 420 are approximately at the same level, the transparent cover 160 is connected to the bottom ends of the lower bodies to seal the bottom ends of the shells 120, 420. FIG. 13 shows the illuminator 400 has a circular-shape light field.

It can be understood that the above-described embodiment are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. A light emitting diode illuminator comprising:

a reflecting shell comprising a plurality of hollow tapered bodies, each body having a taper angle being different from that of the other bodies, cooperatively the bodies forming a receiving space therein;

a light emitting diode light source installed at an end of the receiving space of the reflecting shell, the light emitting diode light source comprising a column-shaped base and a plurality of light emitting diode arrays, each light emitting diode array comprising a plurality of light emitting diodes being arranged linearly, the light emitting diode arrays being evenly arranged on a curved outer surface of the base;

a transparent cover disposed at an opposite end of the reflecting shell away from the light emitting diode light source and configured for directing light emitted from the light emitting diode light source out from the light emitting diode illuminator; and an outer shell mounted around the reflecting shell, two opposing ends of the outer shell being connected to two opposing ends of the reflecting shell, respectively;

wherein the reflecting shell is made of translucent reflecting material.

2. The light emitting diode illuminator of claim 1, wherein the plurality of hollow tapered bodies comprises a first body and a second body interconnecting the first body and the transparent cover, the taper angle of the second body being larger than that of the first body, the light emitting diode light source arranged in the first body.

3. The light emitting diode illuminator of claim 1, wherein the transparent cover is a flat board.

4. The light emitting diode illuminator of claim 1, wherein the transparent cover is one of the following lenses: a spherical lens, an aspherical lens, a micro-lens array, a micro-prism array, a lenticular array, and a Fresnel lens.

5. The light emitting diode illuminator of claim 1, wherein the light emitting diode arrays are arranged parallel to each other.

6. The light emitting diode illuminator of claim 1, wherein the light emitting diode arrays are parallel to an axis of the light emitting diode illuminator.

* * * * *